US006958955B2

(12) United States Patent
Yuzuki et al.

(10) Patent No.: US 6,958,955 B2
(45) Date of Patent: Oct. 25, 2005

(54) ELECTRONIC TIMEPIECE

(75) Inventors: Toshiyuki Yuzuki, Chiba (JP); Scott H. Wilson, Beaverton, OR (US)

(73) Assignees: Seiko Instruments Inc., Chiba (JP); Nike, Inc., Beaverton, OR (US)

( * ) Notice: Subject to any disclaimer, the term of this patent is extended or adjusted under 35 U.S.C. 154(b) by 294 days.

(21) Appl. No.: 10/397,864

(22) Filed: Mar. 26, 2003

(65) Prior Publication Data

US 2004/0071047 A1 Apr. 15, 2004

(30) Foreign Application Priority Data

Mar. 27, 2002 (JP) ..... 2002-087608

(51) Int. Cl.[7] ..... G04B 19/00; G04B 25/00
(52) U.S. Cl. ..... 368/82; 368/223
(58) Field of Search ..... 368/82, 239, 223

(56) References Cited

U.S. PATENT DOCUMENTS 4,398,834 A 8/1983 Wakai ..... 368/223
5,140,563 A * 8/1992 Thinesen ..... 368/70
5,257,245 A * 10/1993 Thinesen ..... 368/70
5,801,637 A * 9/1998 Lomholt ..... 340/815.69
5,886,954 A 3/1999 Asami et al. ..... 368/67

FOREIGN PATENT DOCUMENTS

GB 2111729 3/1982

* cited by examiner

*Primary Examiner*—Vit W. Miska
(74) *Attorney, Agent, or Firm*—Adams & Wilks

(57) ABSTRACT

An electronic timepiece has an operating unit for switching between a time display mode and a demo display mode, a time measuring unit for measuring time, and a storing unit for storing a timing condition for switching between the time display mode and the demo display mode. A control unit outputs a time display signal representing time measured by the time measuring unit when the operating unit switches to the time display mode, outputs a demo display signal when the operating unit switches to the demo display mode, and outputs the demo display signal after outputting the time display signal for a preselected period of time when the time measured by the time measuring unit satisfies the timing condition stored by the storing unit.

15 Claims, 7 Drawing Sheets

ELECTRONIC TIMEPIECE

BACKGROUND OF THE INVENTION

1. Field of the Invention

The present invention relates to an electronic timepiece having a demonstration display function.

2. Background Information

An electronic timepiece having a demonstration (hereinafter referred to as demo) display function for displaying a picture and the like has been used so far in order to exhibit it in a shop window and the like for attracting consumer's attention.

FIG. 7 is a block diagram of a conventional electronic timepiece, having the demo display function, which has been used.

In FIG. 7, the electronic timepiece is provided with a switch input portion 701 which is operable to users, a mode storing portion 702 for storing a display mode such as a demo display mode and soon, a display control portion 703, a display driver circuit 704, a display portion 705 having a graphic display function, an oscillator 706 generating a reference clock signal, a dividing circuit 707 for dividing the reference clock signal to generate a time reference signal for measuring time, and a time counter 708 for counting the time reference signal.

Operating the switch input portion 701 causes a time display mode which performs a time display, the demo display mode which performs a demo display and the like to be set, and switching the display mode causes the display of the display mode set by the switch input portion 701 to be performed on the display portion 705.

The above operation is explained in detail as follows. The dividing circuit 707 divides the reference clock signal generated by the oscillator 706 to output the time reference signal. The time counter 708 counts the time reference signal to output a time signal representing time.

When the time display mode is set by the switch input portion 701, the mode storing portion 702 stores information representing the time display mode to output a display mode signal representing the time display mode to the display control portion 703. The display control portion 703 responds to the display mode signal representing the time display mode to output a time signal outputted from the time counter 708 to the display driver circuit 704. The display driver circuit 704 converts the time signal into a form suitable for displaying and outputs it to the display portion 705. This causes current time to be displayed on the display portion 705.

On the other hand, when the demo display mode is set by the switch input portion 701, the mode storing portion 702 stores information representing the demo display mode to output a display mode signal representing the demo display mode to the display control portion 703. The display control portion 703 responds to the display mode signal representing the demo display mode to output data for the demo display stored beforehand in a memory (not shown) of the display control portion 703 to the display driver circuit 704. The display driver circuit 704 converts the data for the demo display into a form suitable for displaying and outputs it to the display portion 705. This causes the demo display to be performed on the display portion 705. In the demo display, for example, displays such as an automatically sequential display of functions of the electronic timepiece, an animation display of a company logo and so on are performed in order to attract consumer's attention.

As mentioned above, operating the switch input portion 701 permits the time display mode and the demo display mode to be switched to display.

However, there is a problem that, because the conventional electronic timepiece has priority to attract consumer's attention, emphasis is placed primarily on the demo display while the time display as an originally essential function of the timepiece is disregarded.

For example, there is a problem that, in case that both a demo display region and a time display region in the display portion 705 are in the same region, because a narrow display region is used for indication, it is difficult to distinguish whether the display portion 705 indicates the demo display or the time display.

Furthermore, since the conventional timepiece is arranged to give priority not to confirm the normal time display but to confirm the demo display, for example, even in case that the conventional timepiece has a feature of a displaying aspect of changing the time on the minute, there exists a problem that the feature of the displaying aspect can not be appealed to consumers.

A problem to be solved by the invention is that the time can be confirmed even in the demonstration display mode.

Another problem to be solved by the invention is that, even in case that the electronic timepiece has the feature of displaying aspect of changing the time on the minute, the feature of the displaying aspect can be appealed to consumers.

SUMMARY OF THE INVENTION

According to the invention, an electronic timepiece performs display by switching at least between a time display mode and a demo display mode. The electronic timepiece has an operating unit for switching between the time display mode and the demo display mode, a time measuring unit for measuring time, a storing unit for storing a certain timing condition for switching displays, a control unit which outputs the time display signal representing the time measured by the time measuring unit when the time display mode is set by the operating unit, outputs a demo signal when the demo display mode is set by the operating unit and outputs the demo display signal again after outputting the time display signal for a certain duration when the time measured by the time measuring unit satisfies the timing condition for switching displays, and a display unit which responds to the time display signal to perform the time display and responds to the demo display signal to perform the demo display.

The control unit outputs the time display signal representing the time measured by the time measuring unit when the time display mode is set by the operating unit, outputs a demo display signal when the demo display mode is set by the operating unit and outputs the demo display signal again after outputting the time display signal for a certain duration when the time measured by the time measuring unit satisfies the timing condition for switching displays. The display unit responds to the time display signal to perform the time display and also responds to the demo display signal to perform the demo display.

In case that a first timing condition and a second timing condition after a certain duration of the first timing condition are set as the timing condition for switching displays and the demo display mode is set, the control unit may also be constituted so as to output the time display signal when the time measured by the timing unit satisfies the first timing condition, and output the demo display signal when the time measured by the time measuring unit satisfies the second timing condition.

It may also be constituted that a value of seconds digits of certain seconds to the minute is set as the first timing condition and a value of seconds digits of certain seconds past the minute is set as the second condition.

The control unit may also be constituted so as to comprise a seconds digits comparing unit which outputs a switching signal of the time display for switching from the demo display to the time display when the seconds digits of the time measured by the time measuring unit corresponds to the first timing condition and outputs the switching signal of the demo display for switching from the time display to the demo display when the seconds digits of the time measured by the time measuring unit corresponds to the second condition, and a display control unit which responds to the switching signal of the time display to output the time display signal and responds to the switching signal of the demo display to output the demo display signal.

It may also be constituted that, a third timing condition and a predetermined duration are set as the timing condition for the switching displays, and in case that the demo display mode is set, the control unit outputs the demo display signal and outputs the demo display signal again after outputting the time display signal for the predetermined duration when the time measured by the time measuring unit satisfies the third timing condition.

It may also be constituted that a value of seconds digits of certain seconds to the minute is set as the third timing condition and a value of seconds digits which the sum of the value of the predetermined duration and the value of the third timing condition exceeds the minute is set as the predetermined duration.

The control unit may also be constituted so as to comprise a seconds digits comparing unit which outputs the switching signal of the time display for switching from the demo display to the time display when the seconds digits of the time measured by the time measuring unit corresponds to the third timing condition, and a display control unit which corresponds to the switching signal of the time display to output the time display signal and outputs the demo display signal after the predetermined duration when the seconds digits of the time measured by the time measuring unit corresponds to the third timing condition.

It may also be constituted that the timing condition for switching displays is set by the operating unit.

It may also be constituted that, in the demo display mode, a notifying unit for notifying the switching displays in case of switching from the demo display mode to the time display mode is provided

BRIEF DESCRIPTION OF THE DRAWINGS

A preferred embodiment of the invention will now be described with reference to the accompanying drawings wherein.

DETAILED DESCRIPTION OF THE PREFERRED EMBODIMENTS

Figure 1:
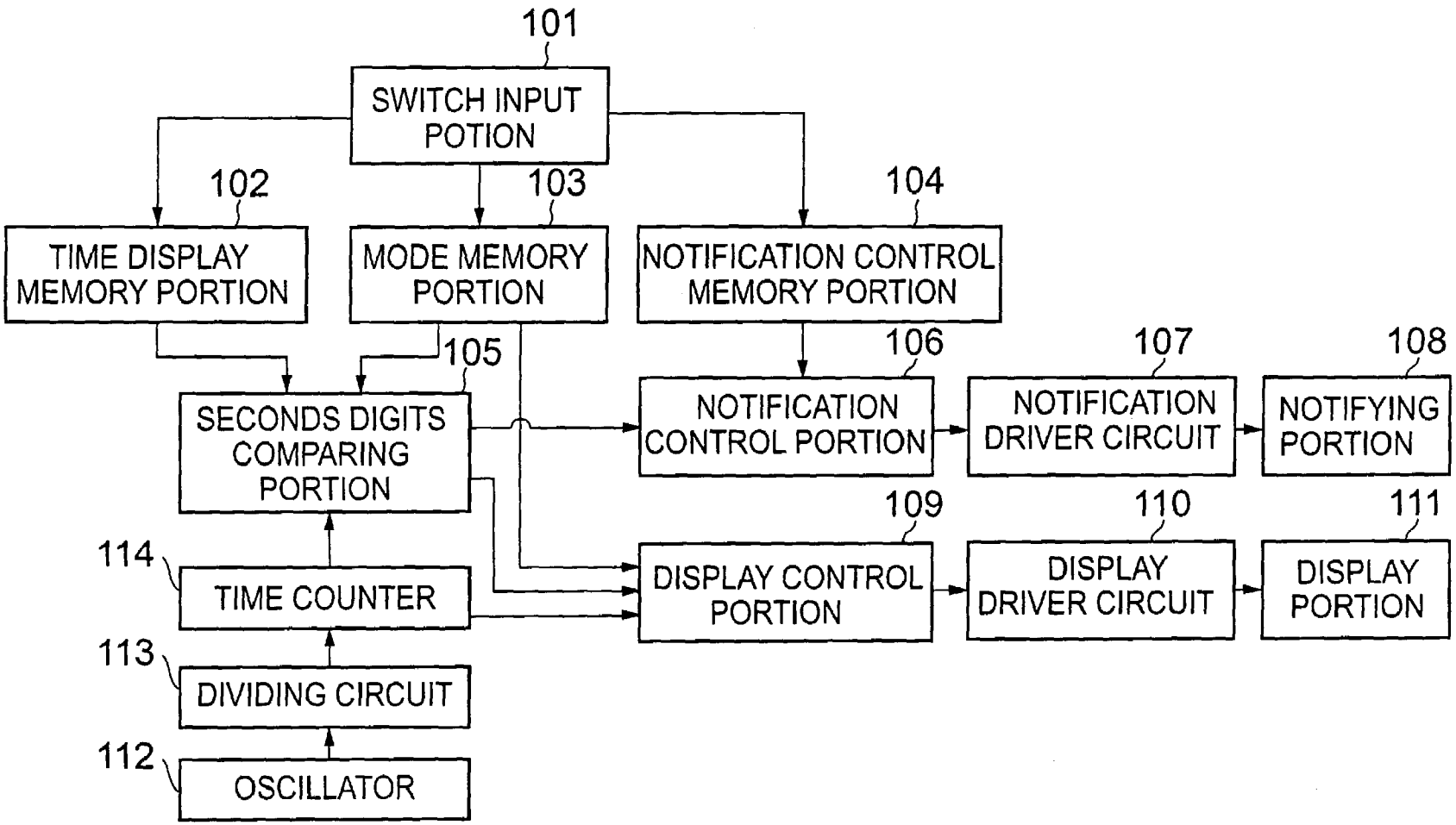
FIG. 1 is a block diagram showing an electronic timepiece according to a mode for carrying out the invention.

FIG. 1 is a block diagram showing an electronic timepiece according to a mode for carrying out the invention, and the block diagram is common in first and second modes for carrying out the invention.

In FIG. 1, the electronic timepiece is provided with a switch input portion 101, a time display storing portion 102 as a timing condition for switching displays storing unit for storing the timing condition for switching displays, a mode storing portion 103 as a mode storing unit for storing a present display mode, a notification control storing portion 104 as an information of notification control storing unit for storing the information of notification control whether notifies or not, a seconds digits comparing portion 105 as a seconds digits comparing unit for comparing the seconds digits of time, a notification control portion 106 as a notification control unit for controlling the notification, a notification driver circuit 107 for driving a notifying portion 108, the notifying portion 108 for performing the notification, a display control portion 109 as a display control unit for controlling the display, a display driver circuit 110 for driving a display portion 111, the display portion 111 constituting a display unit with the display driver circuit 110 and performing a time display, a demo display and so on, an oscillator 112 for generating a reference clock signal, a dividing circuit 113 for dividing the reference clock signal to generate a time reference signal for measuring time and a time counter 114 as a time measuring unit for counting the time reference signal.

The control unit is constituted by the time diplay storing portion 102, the mode storing portion 103, the seconds digits comparing portion 105, the display control portion 109 and the time counter 114. The notifying unit is constituted by the notification control storing portion 104, the notification control portion 106, the notification driver circuit 107 and the notifying portion 108. The notifying portion 108 has at least one of notifying functions including a sound notifying function for notifying by sound, a visually notifying function for notifying visually by illuminating or flashing of an illuminating element (LED or EL), vibration notifying function for notifying by vibration and the like. The display portion 111 has a graphic display function for showing characters, graphs and so on.

Figure 2:
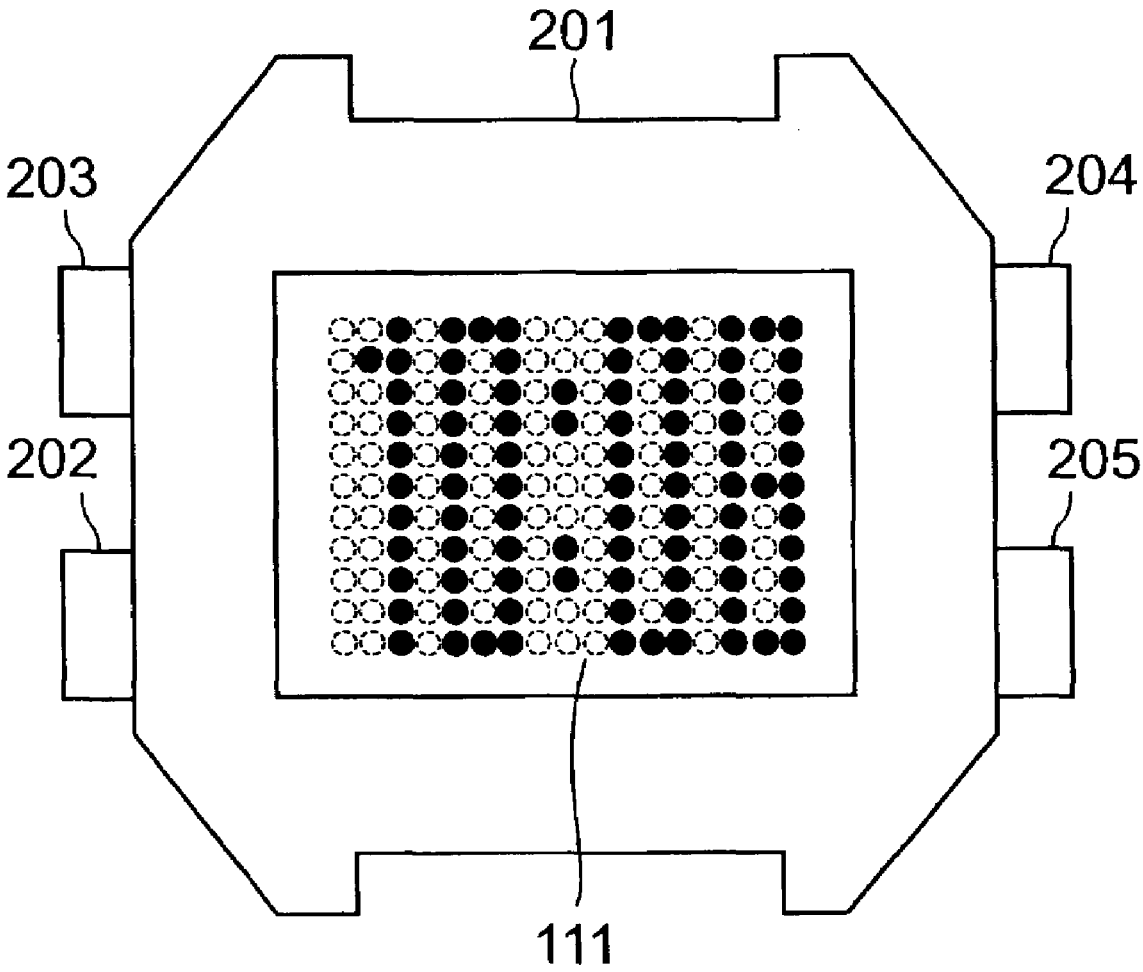
FIG. 2 is an appearance view of an electronic timepiece according to a mode for carrying out the invention.

FIG. 2 is an appearance view of an electronic timepiece according to a mode for carrying out the invention, the appearance view is common in first and second modes for carrying out the invention. The same reference numerals are applied to the same portions in FIG. 1 and FIG. 2. The electronic timepiece is provided with a chassis 201, the display portion 111 and operating buttons 202 to 205 for operating the switch input portion 101. The operating unit is constituted by the operating buttons 202 to 205 and the switch input portion 101. Operating each operating button 202 to 205 causes a signal in accordance with operation of each operating buttons 202 to 205 to be outputted from the switch input portion 101.

The operating button 202 is an operating switch for switching display modes in the display portion 111. With each pressing operation of the operating button 202, a sequential display modes corresponding to a time display mode representing current time, a date display mode representing a present date, a chronograph mode representing measured time and an alarm mode representing an alarm are rotationally switched.

The operating button 203 is an operating button for entering a state of correction which includes adjustment of time and a date, setting of the alarm, setting of a timing condition for switching between the demo display and a current time display during the demo display, on/off of notifying function in the demo display mode and so on.

The operating button 204 is an operating button for on/off of confirmation sound for operation and a time signal, start/stop of the chronograph, on/off of the alarm, and setting of the time, the date and so on in the state of correction.

The operating button 205 is an operating button for switching to the demo display mode, resetting the chronograph and switching segments as an object of correction in the state of correction.

Figure 3:
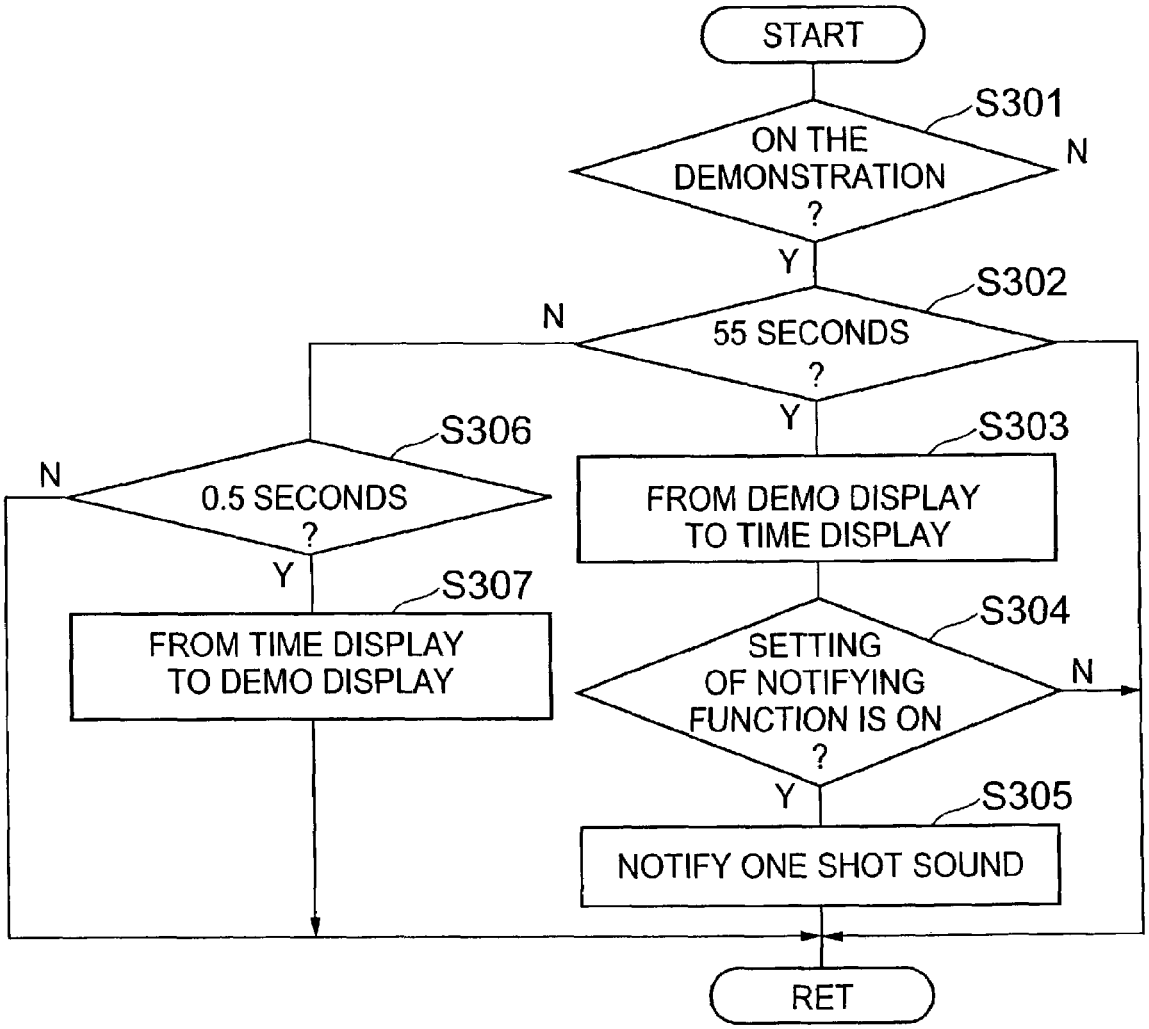
FIG. 3 is a flowchart showing a process of an electronic timepiece according to the first mode for carrying out the invention.
Figure 5:
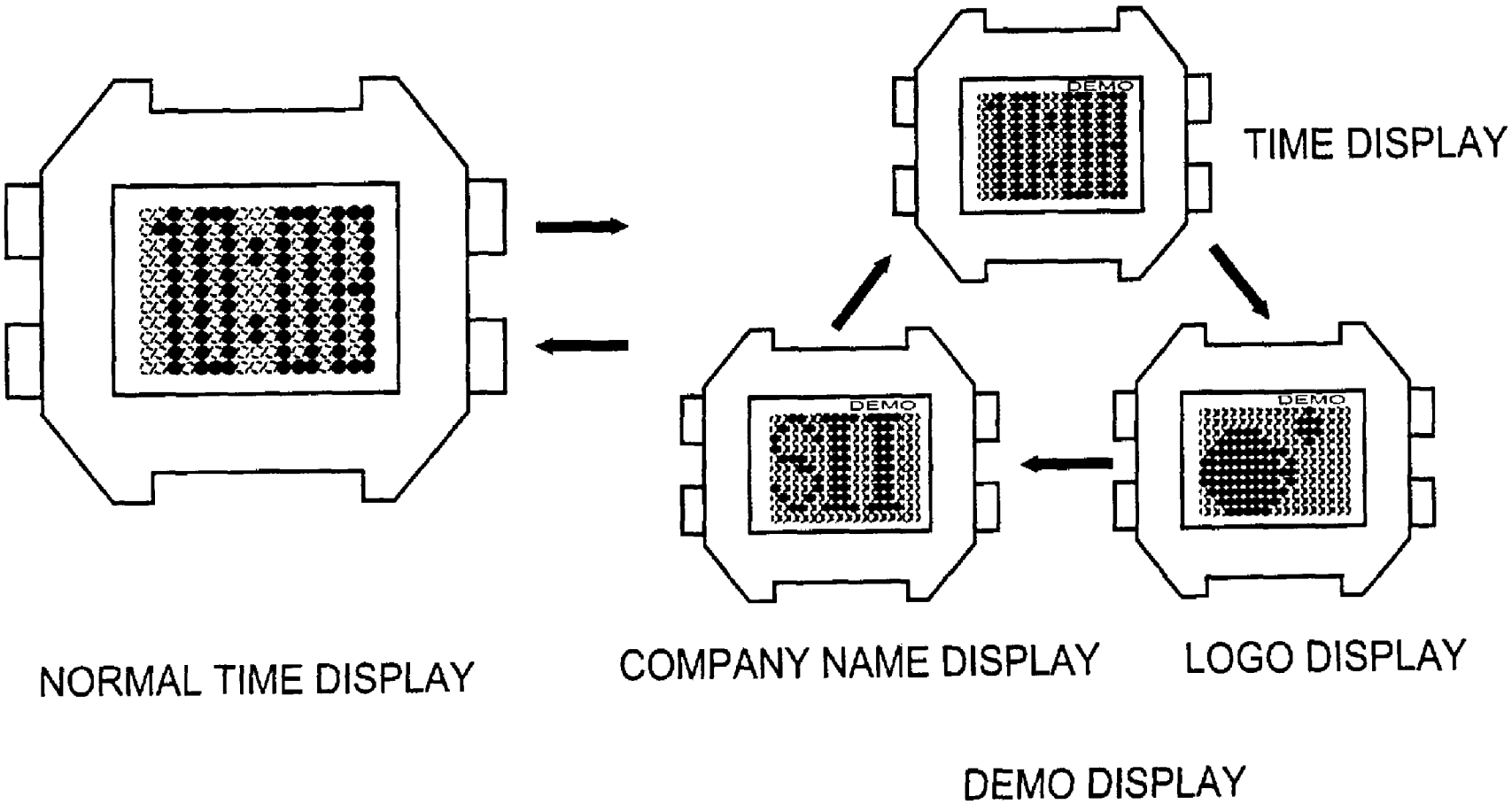
FIG. 5 is a displaying aspect of an electronic timepiece according to the first mode for carrying out the invention.

FIG. 3 is a flow chart showing a process according to the first mode for carrying out the invention. FIG. 5 is a displaying aspect according to the first mode for carrying out the invention.

Operation of the first mode for carrying out the invention is explained by using FIG. 1 to FIG. 3 and FIG. 5 as follows.

At first, by operating the operating button 203, the timing for switching between the demo display and the time display in the demo display mode is inputted, which sets the timing condition for switching displays. When the timing condition for switching displays is inputted by the operating button 203, the timing condition for switching displays is outputted from the switch input portion 101 to the time display storing portion 102 and the timing condition for switching displays is stored in the time display storing portion 102. In the first mode for carrying out the invention, the first timing condition of certain time to the minute (00 seconds) and the second timing condition of certain time past the minute (for example, the first timing condition is 55 seconds, the second timing condition is 5 seconds are set as the timing conditions for switching displays. A value of seconds digits of a certain seconds to the minute is set as the first timing condition, a value of seconds digits of a certain seconds past the minute is set as the second condition.

The dividing circuit 113 divides the reference clock signal generated by the oscillator 112 to output the time reference signal. The time counter 114 counts the time reference signal to output a time signal representing the time to the seconds digits comparing portion 105 and the display control portion 109.

When the time display mode is set by operating the operating button 202, information representing the time display mode (the information of the time display mode) is outputted from the switch input portion 101, and the information of the time display mode is stored in the mode storing portion 103. The mode storing portion 103 outputs the stored information of the time display mode to the seconds digits comparing portion 105 and the display control portion 109.

The display control portion 109 receives the information of the time display mode to judge it is the time display mode, then outputs a signal representing the current time measured by the time counter 114 to the display driver circuit 110. The display driver circuit 110 converts the signal representing the current time from the display control portion 109 into a form to be suitable for the display and output it to the display portion 111. The display portion 111 displays the current time as shown in FIG. 2 (the time is 10:08 in FIG. 2). The seconds digits comparing portion 105 does not perform a comparing operation in case that the seconds digits comparing portion 105 has received the information of the time display mode.

On the other hand, when the demo display mode is set by operating the operating button 202, information representing the demo display mode (the information of the demo display mode) is outputted from the switch input portion 101 and the information of the demo display mode is stored in the mode storing portion 103. The mode storing portion 103 outputs the information of the demo display mode to the seconds digits comparing portion 105 and the display control portion 109.

When the seconds digits comparing portion 105 receives the information of the demo display mode from the mode storing portion 103, the seconds digits comparing portion 105 performs the comparing operation for detecting whether the time measured by the time counter 114 satisfies the timing condition for switching displays stored in the time display storing portion 102 or not. In specific, the seconds digits comparing portion 105 detects whether the seconds digits of the time measured by the time counter 114 corresponds to the first timing condition (55 seconds) stored in the time display storing portion 102 or not.

In case when the seconds digits comparing portion 105 detects that the time measured by the time counter 114 satisfies the timing condition for switching displays stored in the time display storing portion 102, that is to say, in case when the seconds digits comparing portion 105 detects that the seconds digits of the time measured by the time counter 114 reaches the first timing condition (55 seconds), the seconds digits comparing portion 105 outputs a switching signal of the time display for switching to the current time display to the display control portion 109, and at the same time the seconds digits comparing portion 105 outputs a first notification directing signal for performing the notification to the notification control portion 106

In case when the seconds digits comparing portion 105 detects that the seconds digits of the time measured by the time counter 114 reaches the second timing condition (5 seconds), the seconds digits comparing portion 105 outputs a switching signal of the demo display for switching from the current time display to the demo display to the display control portion 109.

According to the signal from the mode storing portion 103, the display control portion 109 judges whether the demo display mode is set or not (step S301). When the display control portion 109 receives the information of the demo display mode, the display control portion 109 judges that the demo display mode is set and outputs a display signal for the demo display mode (the demo display signal) stored beforehand in a memory (not shown) of the display control portion 109 to the display driver circuit 110. The display driver circuit 110 drives the display portion 111 in order to perform the demo display, which performs the demo display on the display portion 111 as shown in FIG. 5. That is to say, as shown in the right side of FIG. 5, sequential demo displays of a company name display, a display of a time form and a logo display are performed repeatedly for a certain duration. Characters of "DEMO" for representing the demo display are indicated in each display. Particularly, since the display of the time form in the demo display mode in FIG. 5 represents not the current time but just the form of the time display as one of the demo displays, the indication (DEMO) representing the demo display is displayed so as not to confuse with the normal (ordinary) time display.

The display control portion 109 judges whether the time measured by the time counter 114 is satisfied with the timing condition for switching displays stored in the time display storing portion 102. In specific, in case when the seconds digits comparing portion 105 detects that the seconds digits of the time measured by the time counter 114 corresponds to the first timing condition (55 seconds) stored in the time display storing portion 102, the display control portion 109 judges whether the switching signal of the time display outputted from the seconds digits comparing portion 105 is received or not. That is to say, the display control portion 109 judges whether the seconds digits of the time counter 114 reaches 55 seconds or not (step S302).

Receiving the switching signal of the time display, the display control portion 109 judges that the seconds digits of the time counter 114 reaches 55 seconds, then the display control portion 109 outputs information of the current time measured by the time counter 114 to the display driver circuit 110 (step S303). The display driver circuit 110 drives the display portion 111 in order to display the current time, which causes the current time to be displayed on the display portion 111 as shown in the left side of FIG. 5. Because the character indication of "DEMO" is not displayed in case of the display of the current time, it is distinguishable to be the display of the current time.

At the same time, according to information of notification setting from the notification control storing portion 104, the notification control portion 106 judges whether the notifying function is set (on) or not (off) (step S304), and in case when the notification control portion 106 judges that the notifying function is set, the notification control portion 106 responds to the first notifying signal to output a first notification drive signal to the notification portion 108 via the notification driver circuit 107. The notifying portion 108 performs a certain notification (for example, notification by one shot sound) by a first notification drive signal (step S305). This results in switching from a state of the demo display to a state of the time display and performing a certain notification, at the same time, the demo display for calling consumer's attention is performed and switching from the demo display to the time display can also be appealed.

In case of reaching on the minute in the state of the current time display, changing digit portions of hour digits and minute digits on the minute are scrolled to change. As a result, in case of a timepiece having a feature of switching of the hour and the minute on the minute, the feature can be emphasized to consumers.

In the step S302, in case when the display control portion 109 judges that the display control portion 109 has not received the switching signal of the demo display from the seconds digits comparing portion 105, that is to say, in case when the display control portion 109 judges that the seconds digits of the time measured by the time counter 114 does not correspond to the first timing condition (55 seconds), then the display control portion 109 judges whether the seconds digits of the time measured by the time counter 114 corresponds to the second timing condition (5 seconds). That is to say, the display control portion 109 judges whether the display control portion 109 has received the switching signal of the demo display from the seconds digits comparing portion 105 or not.

In the step S306, in case when the display control portion 109 judges that the display control portion 109 has received the switching signal of the time display from the seconds digits comparing portion 105, that is to say, in case when the display control portion 109 judges that the seconds digits of the time measured by the time counter 114 corresponds to the second timing condition (5 seconds), the display control portion 109 outputs the display signal of the demo display mode stored beforehand in the memory (not shown) of the display control portion 109 to the display driver circuit 110 (step S307). The display driver circuit 110 drives the display portion 111 in order to perform the demo display, which cause the demo display to be performed on the display portion 111 as shown in the right side of FIG. 5.

Repeating the operation described above, in the demo display mode, causes the demo display to be performed, at the same time, when the time measured by the time counter 114 satisfies the timing condition for switching displays stored in the time display storing portion 102, the normal time display is performed for only a certain duration.

In the demo display mode, when any of operating buttons 202 to 205 is operated, the display control portion 109 detects the operation, terminates the demo display mode and changes to the time display mode.

An electronic timepiece according to the second mode for carrying out the invention is explained next. A block diagram and an appearance view according to the second mode for carrying out the invention are the same as FIG. 1 and FIG. 2 respectively.

Figure 4:
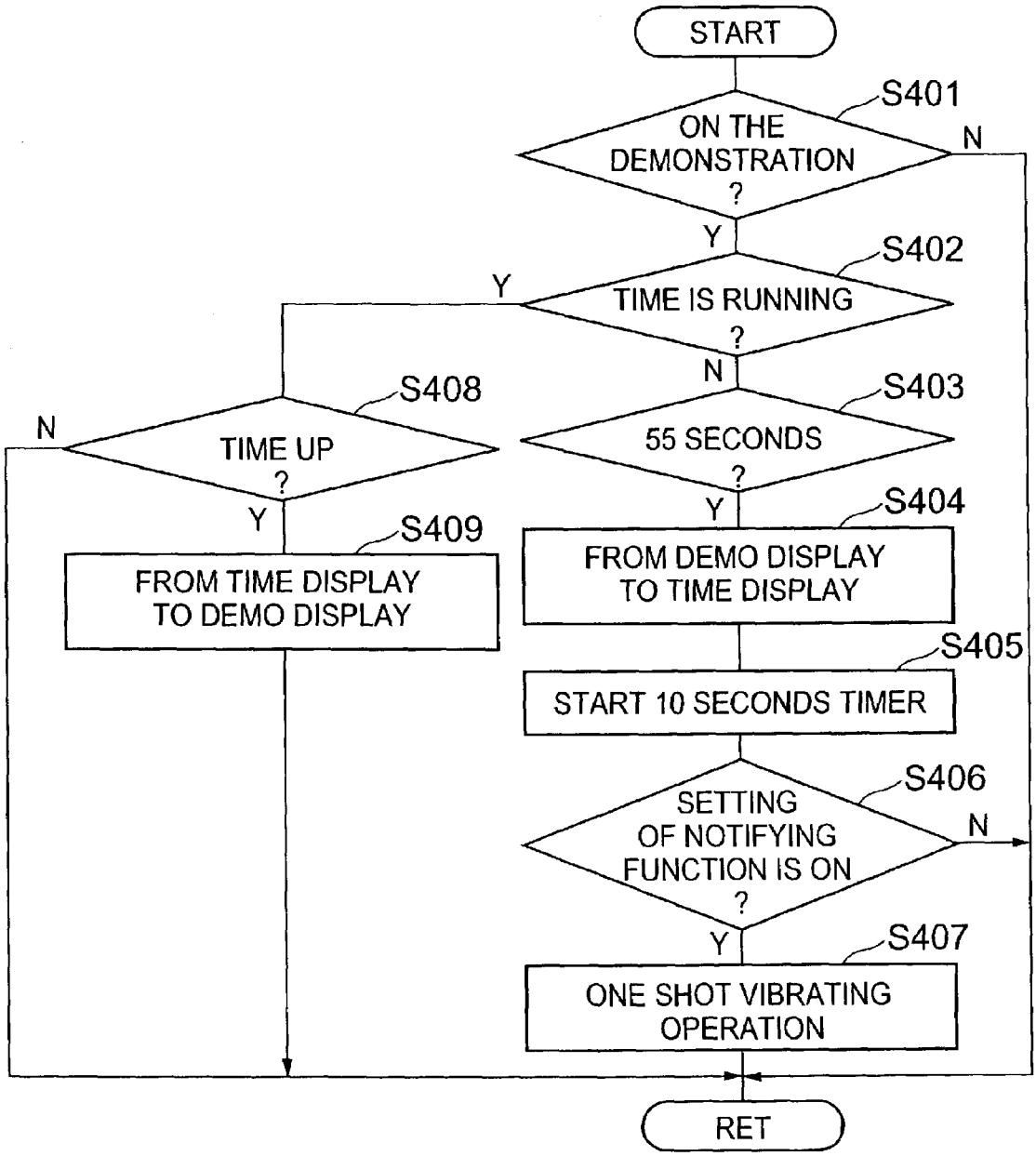
FIG. 4 is a flowchart showing a process of an electronic timepiece according to the second mode for carrying out the invention.
Figure 6:
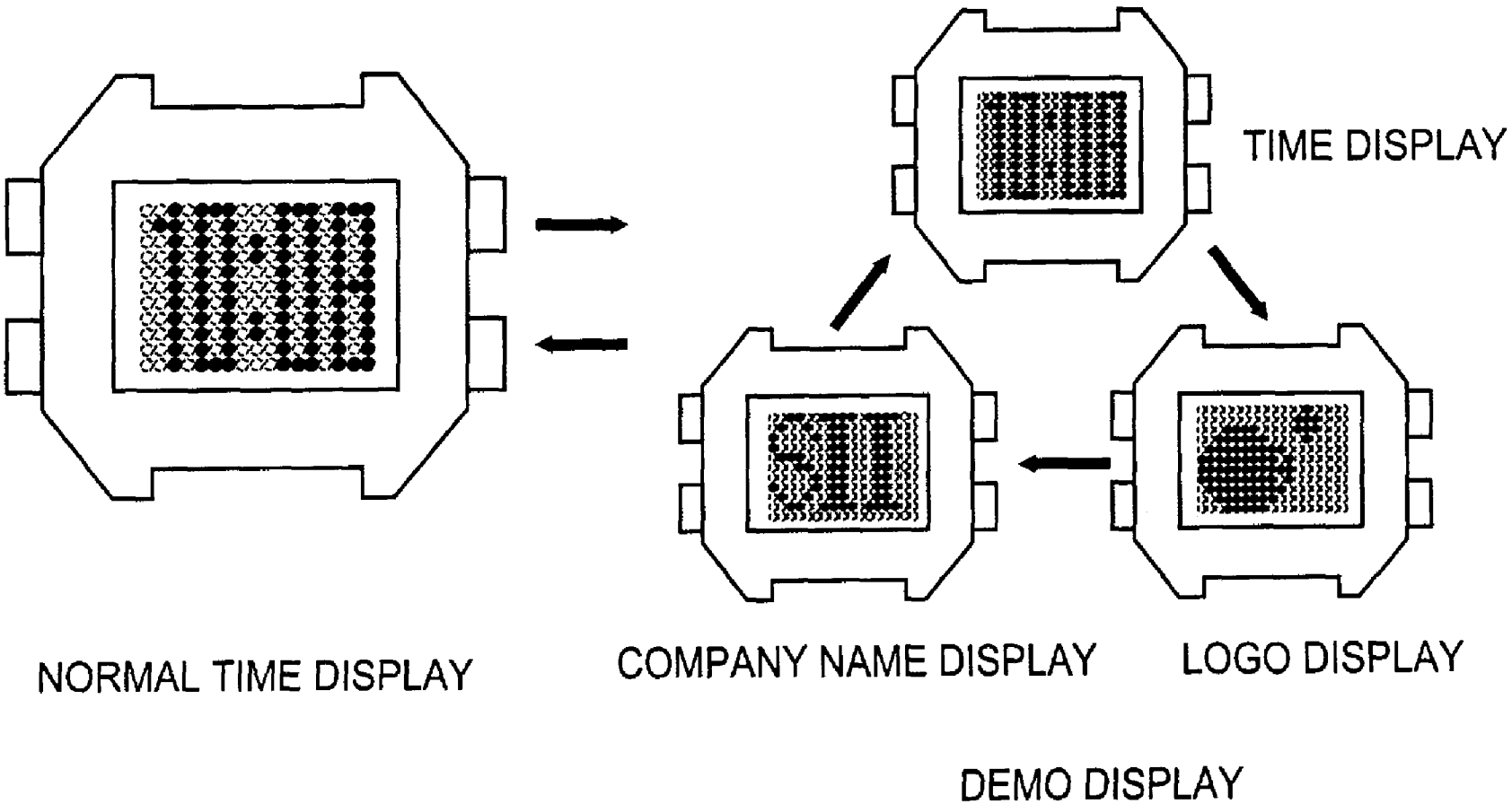
FIG. 6 is a displaying aspect of an electronic timepiece according to the second mode for carrying out the invention.
Figure 7:
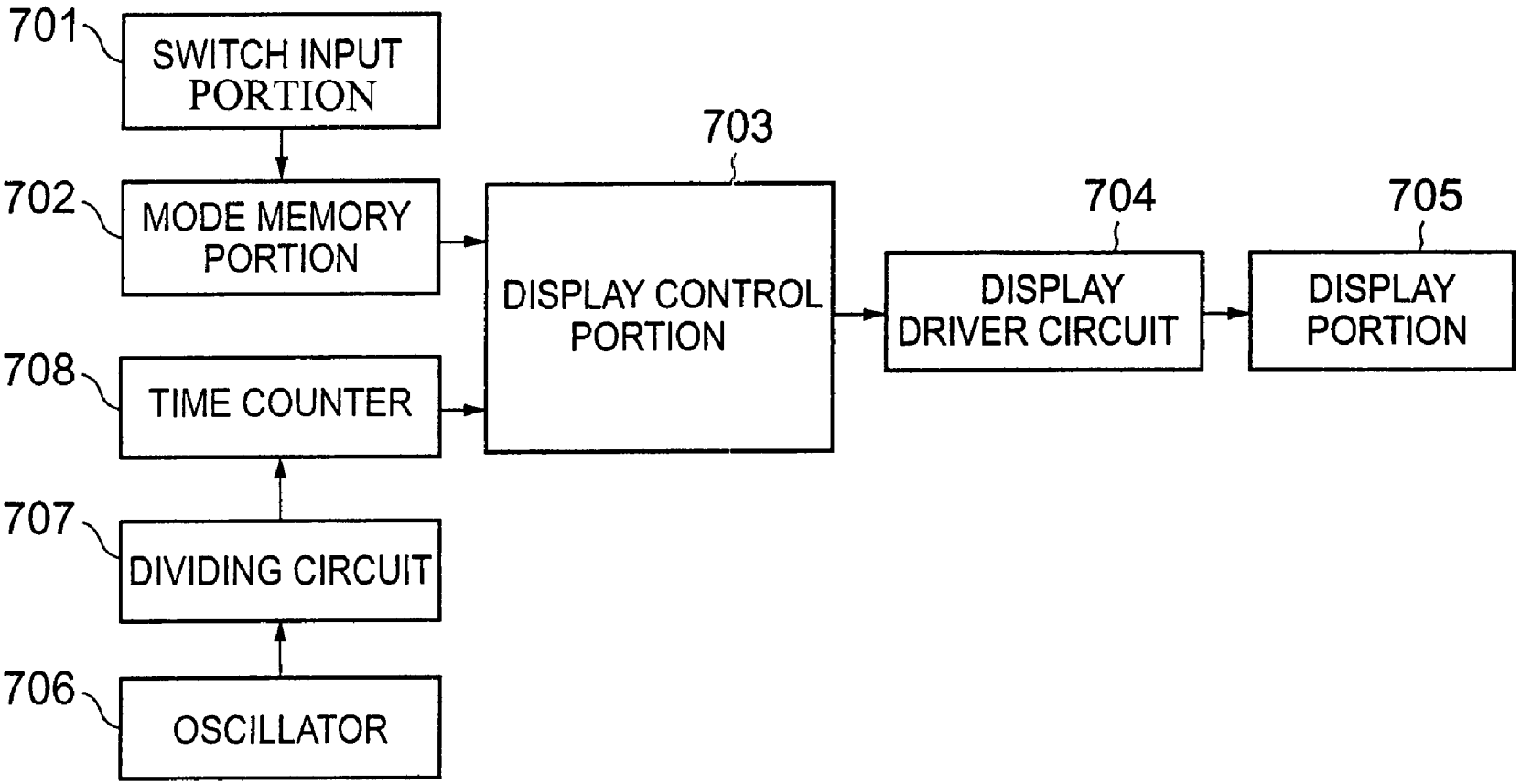
FIG.7 PRIOR ART
FIG. 7 is a block diagram of a conventional electronic timepiece.

FIG. 4 is a flow chart showing a process according to the second mode for carrying out the invention. FIG. 6 is a displaying aspect according to the second mode for carrying out the invention.

A difference between the second mode for carrying out the invention and the first mode for carrying out the invention is that, in the first mode for carrying out the invention, the first timing condition of certain time to the minute and the second timing condition of certain time past the minute are set as the timing condition for switching displays, on the other hand, in the second mode for carrying out the invention, a third timing of certain time to the minute and a predetermined duration are arranged to be set. A value of seconds digits of certain seconds to the minute is set as the third timing condition, and a value of seconds digits which the sum of the value of the predetermined duration and the value of the third timing condition exceeds the minute is set as the predetermined duration.

Furthermore, in the first mode for carrying out the invention, in case of the display of time form in the demo display mode, displaying the characters of "DEMO" makes distinguishable from the normal (ordinary) time display, on the other hand, in the second mode for carrying out the invention, changing display density between the normal time display in the time display mode and the display of the time form in the demo display mode makes distinguishable the time display from the display of the time form.

The operation of the second mode for carrying out the invention is explained with reference to FIG. 1, FIG. 2, FIG. 4 and FIG. 6.

Operating the operating button 203 and inputting a display timing of current time in the demo display mode sets a timing of switching displays (the timing condition for switching displays). When the timing condition for switching displays is inputted from the operating button 203, the timing condition for switching displays is outputted from the switch input portion 101 to the time display storing portion 102, and the timing condition for switching displays is stored in the time display memory storing 102. In the second mode for carrying out the invention, the third timing condition of certain time to the minute (00 seconds) and the predetermined duration (for example, the third timing condition is 55 seconds, the predetermined duration is 10 seconds) are set as the timing condition for switching displays.

The dividing circuit 113 divides the reference clock signal generated by the oscillator 112 to output the time reference signal. The time counter 114 counts the time reference signal to output the time signal representing time to the seconds digits comparing portion 105 and the display control portion 109.

When the time display mode is set by operating the operating button 202, information representing the time display mode (the information of the time display mode) is outputted from the switch input portion 101, and the information of the time display mode is stored in the mode storing portion 103. The mode storing portion 103 outputs the stored information of the time display mode to the seconds digits comparing portion 105 and the display control portion 109.

The display control portion 109 receives the information of the time display mode to judges it is the time display mode, and outputs a signal representing current time measured by the time counter 114 to the display driver circuit 110. The display driver circuit converts the signal representing the current time received from the display control portion 109 into a form to be suitable to a display to output the display portion 111, and the display portion 111 displays the current time (it is 10:08 in FIG. 2) as shown in FIG. 2. The seconds digits comparing portion 105 does not perform the comparing operation in case that the seconds digits comparing portion 105 has received the information of the time display mode.

On the other hand, when the demo display mode is set by operating the operating button 202, information representing the demo display mode (the information of the demo display mode) is outputted from the switch input portion 101, and the information of the demo display mode is stored in the mode storing portion 103. The mode storing portion 103 outputs the stored information of the demo display mode to the seconds digits comparing portion 105 and the display control portion 109.

According to the signal received from the mode storing portion 103, the display control portion 109 judges whether the demo display mode is set or not (step S401). When the display control portion 109 receives the information of the demo display mode from the mode storing portion 103, the display control portion 109 judges that the demo display mode is set and outputs the display signal (the demo display signal) for the demo display mode stored beforehand in the memory (not shown) of the display control portion 109 to the display driver circuit 110. The display driver circuit 110 drives the display portion 111 in order to perform the demo display.

Consequently, the demo display is performed on the display portion 111 as shown in FIG. 6. As shown in the right side of FIG. 6, sequential demo displays of a company name display, the display of time form and a logo display are repeatedly displayed for certain duration. In order to recognize that each display is the demo display, each display is shown in high density compared with the normal (ordinary) time display. As a result, it is distinguishable that the display of time form in FIG. 6 shows not the current time but a form for displaying the time as one of the sequential demo displays.

On the other hand, when the seconds digits comparing portion 105 receives the information of the demo display mode from the mode storing portion 103, the seconds digits comparing portion 105 performs the comparing operation for detecting whether the time measured by the time counter 114 satisfies the timing condition for switching displays stored in the time display storing portion 102 or not. In specific, the seconds digits comparing portion 105 detects whether the seconds digits of the time measured by the time counter 114 corresponds to the third timing condition (55 seconds) stored in the time display storing portion 102 or not.

When the seconds digits comparing portion 105 detects that the time measured by the time counter 114 satisfies the timing condition for switching displays stored in the time display storing portion 102, that is to say, when the seconds digits comparing portion 105 detects that the seconds digits of the time measured by the time counter 114 has reached the third timing condition (55 seconds), the seconds digits comparing portion 105 outputs the switch signal of the time display for switching to the display of the current time to the display control portion 109, at the same time, the seconds digits comparing portion 105 outputs a second notification directing signal for making the notification control portion 106 notify.

The display control portion 109 judges whether a timer (not shown) in the display control portion 109 is operated or not (step S402). The timer is a timer (10 seconds timer) for measuring the predetermined duration (the predetermined duration is 10 seconds in the second mode for carrying out the invention).

When the display control portion 109 judges that the timer in the display control portion 109 is not operated, the display control portion 109 judges whether the time measured by the time counter 114 satisfies the timing condition for switching displays stored in the time display memory portion 102 or not. In specific, when the seconds digits comparing portion 105 has detected that the seconds digits of the time measured by the time counter 114 corresponds to the third timing condition (55 seconds) stored in the time display storing portion 102, the display control portion 109 judges whether the display control portion 109 has received the switching signal of the time display outputted from the seconds digits comparing portion 105 or not. That is to say, the display control portion 109 judges whether the seconds digits of the time counter 114 has reached 55 seconds or not (step S403).

When the display control portion 109 judges that the seconds digits of the time counter 114 has reached 55 seconds by receiving the switching signal of the time display, the display control portion 109 outputs the information of the current time measured by the time counter 114 to the display driver circuit 110 (step S404) and starts up the timer in the display control portion 109 (step S405). The display driver circuit 110 drives the display portion 111 in order to display the current time, which causes the current time to be displayed on the display portion 111 as shown in the left side of FIG. 6. In case of displaying the current time, because the display of the current time is displayed in low density compared with the demo display, it is distinguishable to be the display of the current time.

At the same time, according to the information of notification setting from the notification control storing portion 104, the notification control portion 106 judges whether the notifying function is set (on) or not (off) (step S406), when the notification control portion 106 judges that the notifying function is set, the notification control portion 106 responds to the second notification directing signal to output a second notification drive signal to the notifying portion 108 via the notification driver circuit 107. The notifying portion 108 performs a certain notification (for example, vibrating operation of one shot) by the second notification drive signal (step S407). This results in switching from a state of the demo display to a state of the time display and performing a certain notification, at the same time, the demo display for calling consumer's attention is performed and the switch from the demo display to the time display can also be appealed.

In case of reaching on the minute in the state of the current time display, changing digit portions of hour digits and minute digits are scrolled to change. As a result, in case of a timepiece having a feature of switching of the hour and the minute on the minute, the feature can be emphasized to consumers.

On the other hand, in the step S402, when the display control portion 109 judges that the timer is operated, the display control portion 109 judges whether the timer has measured for 10 seconds (time up) or not (step S408).

When the display control portion 109, in the step S408, judges that the timer is time up, the display control portion 109 outputs the demo display signal stored beforehand in the memory of the display control portion 109 to the display driver circuit 110 (step S409). The display driver circuit 110 drives the display portion 111 in order to perform the demo display, which causes the demo display to be performed on the display portion 111 as shown in the right side of FIG. 6.

Repeating the operation described above, in the demo display mode, causes the demo display to be performed, at the same time, when the time measured by the time counter 114 has reached the timing for switching displays stored in the time display storing portion 102, the ordinary time display can be performed for certain duration.

In the demo display mode, when any operating button 202 to 205 is operated, the display control portion 109 detects the operation, terminates the demo display mode and changes to the time display mode.

As described above, in an electronic timepiece which performs display by switching at least between a time display mode for performing a time display and a demonstration mode for performing a demo display, the electronic timepiece according to the modes for carrying out the invention is characterized by comprising a operating unit (the switch portion 101, the operating buttons 202 to 205) for operating to switch between the time display mode and the demo display mode, the time counter 114 for measuring time, the time display storing portion 102 for storing a certain timing condition for switching displays, a control unit (the time display storing portion 102, the mode storing portion 103, the seconds digits comparing portion 105, the display control portion 109), in case of the time display mode to be set by the control unit, for outputting a time display signal representing the time measured by the time counter 114, in case of the demo display mode to be set by the control unit, outputting a demo display signal and outputting the demo display signal again after outputting the time display signal for certain duration in case that the time measured by the time counter 114 satisfies the timing condition for switching displays, and a display unit (the display driver circuit 110, display portion 111) for corresponding to the time display signal to perform a time display and corresponding to the demo display signal to perform a demo display.

Consequently, in the demo display mode, since the normal time can be displayed in certain timing, the time can be confirmed even in the demo display mode.

Even in case of an electronic timepiece having a feature of a displaying aspect of switching time on the minute, it is possible to emphasize the feature of the displaying aspect to consumers.

In each mode for carrying out the invention described above, though the timing condition for switching displays is arranged to be set by the operating unit, it is also possible that the timing condition for switching displays is arranged to be stored beforehand in the time display storing portion 102.

In the demo display mode, though notification is arranged to be performed from the notifying portion 108 in case of switching from the demo display to the time display, the notification is also arranged to be performed from the notifying portion 108 in case of switching from the time display to the demo display as well as switching from the demo display to the time display.

An electronic timepiece according to the invention can confirm time even in a demo display mode. Even in case of an electronic timepiece having a feature of a displaying aspect of switching time on the minute, it is possible to emphasize the feature of the displaying aspect to consumers.

What is claimed is:

1. An electronic timepiece comprising:

an operating unit for switching between a time display mode and a demo display mode;

a time measuring unit for measuring time;

a storing unit for storing a timing condition for switching between the time display mode and the demo display mode;

a control unit for outputting a time display signal representing time measured by the time measuring unit when the operating unit switches to the time display mode, for outputting a demo display signal when the operating unit switches to the demo display mode, and for outputting the demo display signal after outputting the time display signal for a preselected period of time when the time measured by the time measuring unit satisfies the timing condition stored by the storing unit; and a display unit for performing a time display in accordance with the time display signal and for performing a demo display in accordance with the demo display signal.

2. An electronic timepiece according to claim 1; wherein the timing condition stored by the storing unit comprises a first timing condition and a second timing condition set after a preselected duration of the first timing condition; and wherein the control unit outputs the time display signal when the time measured by the time measuring unit satisfies the first timing condition and outputs the demo display signal when the time measured by the time measuring unit satisfies the second timing condition.

3. An electronic timepiece according to claim 2; wherein a value of seconds digits of certain seconds before the minute is set as the first timing condition and a value of seconds digits of certain seconds past the minute is set as the second timing condition.

4. An electronic timepiece according to claim 3; wherein the control unit comprises a seconds digits comparing unit for outputting a switching signal of the time display mode for switching from the demo display mode to the time display mode when seconds digits of the time measured by the time measuring unit corresponds to the first timing condition and for outputting a switching signal of the demo display mode for switching from the time display mode to the demo display mode when the seconds digits of the time measured by the time measuring unit corresponds to the second timing condition, and a display control unit responsive to the switching signal of the time display mode for outputting the time display signal and responsive to the switching signal of the demo display mode for outputting the demo display signal.

5. An electronic timepiece according to claim 1; wherein the timing condition stored by the storing unit comprises preselected timing condition and corresponding preselected time duration; and wherein when the operating unit switches to the demo display mode, the control unit outputs the demo display signal and outputs the demo display signal again after outputting the time display signal for the preselected time duration when the time measured by the time measuring unit satisfies the preselected timing condition.

6. An electronic timepiece according to claim 5; wherein a value of seconds digits of certain seconds before the minute is set as the third timing condition and a value of seconds digits of which the sum of the value of the preselected timing condition and the value of the preselected time duration exceeds the minute is set as the preselected time duration.

7. An electronic timepiece according to claim 6; wherein the control unit comprises a seconds digits comparing unit for outputting a switching signal of the time display mode for switching from the demo display mode to the time display mode when seconds digits of the time measured by the time measuring unit corresponds to the preselected timing condition, and display control unit responsive to the switching signal of time display mode to output the time display signal and for outputting the demo display signal in case that the preselected time duration passes after the second digits of the time measured by the time measuring unit corresponds to the preselected timing condition.

8. An electronic timepiece according to claim 1; wherein the timing condition for switching between the time display mode and the demo display mode is set by the operating unit.

9. An electronic timepiece according to claim 1; further comprising a notifying unit for notifying, in the demo display mode, a switch by the operating unit from the demo display mode to the time display mode.

10. An electronic timepiece comprising:

switching means for switching an operation between a time display mode for displaying time and a demonstration display mode for displaying a demonstration image;

time measuring means for measuring time;

storing means for storing a preselected timing condition; and control means for outputting a time display signal corresponding to time measured by the time measuring means when the switching means switches the operation to the time display mode, for outputting a demonstration display signal when the switching means switches the operation to the demonstration display mode, and for outputting the demonstration display signal after outputting the time display signal for a preselected period of time when the time measured by the time measuring means satisfies the timing condition stored by the storing means.

11. An electronic timepiece according to claim 10; further comprising display means for displaying time in accordance with the time display signal outputted by the control means and for displaying a demonstration image in accordance with the demonstration display signal outputted by the control means.

12. An electronic timepiece according to claim 11; wherein the preselected timing condition stored by the storing means comprises a first timing condition and a second timing condition set after a preselected duration of the first timing condition; and wherein the control means includes means for outputting the time display signal when the time measured by the time measuring means satisfies the first timing condition and for outputting the demonstration display signal when the time measured by the time measuring means satisfies the second timing condition.

13. An electronic timepiece according to claim 11; wherein the switching means includes means for setting the preselected timing condition stored in the storing means.

14. An electronic timepiece according to claim 11; further comprising notifying means for notifying when the switching means switches from at least one of the time display mode to the demonstration display mode and the demonstration display mode to the time display mode.

15. An electronic timepiece according to claim 14; wherein the notifying means includes means for notifying of the switch by one of sound, vibration, illumination of an illuminating element, and flashing of an illuminating element.

* * * * *